US005239885A

United States Patent [19]

Voigt

[11] Patent Number: 5,239,885

[45] Date of Patent: Aug. 31, 1993

[54] CAMSHAFT WITH A DEACTIVATABLE CAM

[75] Inventor: Dieter Voigt, Wolfsburg, Fed. Rep. of Germany

[73] Assignee: Volkswagen AG, Wolfsburg, Fed. Rep. of Germany

[21] Appl. No.: 896,625

[22] Filed: Jun. 10, 1992

[30] Foreign Application Priority Data

Jun. 28, 1991 [DE] Fed. Rep. of Germany ..... 4121357
Feb. 12, 1992 [DE] Fed. Rep. of Germany ..... 4204048

[51] Int. Cl.[5] ..... F01L 1/04; F16H 53/00

[52] U.S. Cl. ..... 74/567; 123/90.17; 123/90.32

[58] Field of Search ..... 74/567, 568 R, 838; 123/90.6, 90.32, 90.17, 198 F

[56] References Cited

U.S. PATENT DOCUMENTS 4,404,937 9/1983 Leitermann ..... 123/198 F
4,788,946 12/1988 Inoue et al. ..... 123/90.6 X
4,844,022 7/1989 Konno ..... 123/90.6 X
4,887,563 12/1989 Ishida et al. ..... 123/90.17 X

FOREIGN PATENT DOCUMENTS 3920938 1/1990 Fed. Rep. of Germany .
0160014 9/1984 Japan ..... 123/198 F
0162307 9/1984 Japan ..... 123/198 F

*Primary Examiner*—Rodney H. Bonck
*Attorney, Agent, or Firm*—Brumbaugh, Graves, Donohue & Raymond

[57] ABSTRACT

A space-saving camshaft with at least one cam which can be deactivated includes a coupling bolt which slides back and forth transversely in the camshaft to connect and disconnect the cam and the camshaft. A compression spring in the camshaft urges the bolt toward a coupling bore in the cam in the absence of a countervailing force and the bolt can be forced out of the coupling bore by increasing the pressure of hydraulic fluid in an adjacent compartment in the cam to disconnect the cam from the camshaft.

21 Claims, 2 Drawing Sheets

CAMSHAFT WITH A DEACTIVATABLE CAM

BACKGROUND OF THE INVENTION

This invention relates to camshafts having a deactivatable cam.

Camshafts having deactivatable cams have several advantages because they allow intake and outlet valves to be opened and closed, or to be kept closed, in accordance with instantaneous operating conditions of the engine by activatinq or deactivating an associated cam. For example, when an engine has two intake valves and each intake valve is operated by a separate cam that opens the valve for a specific time, it may be practical to allow both valves to operate only at higher engine speeds in order to accommodate the load and to keep one valve closed at lower engine speeds while the other valve, which is optimally designed for lower speeds, continues to be activated by its associated cam. Another application for this type of camshaft is in an internal combustion engine having cylinders which can be rendered inactive. Since all the intake valves for a cylinder in this type of engine can be kept closed when the driver of the vehicle manually deactivates their associated cams, the engine can be operated in an economy mode at less than full load using only some of its combustion chambers.

Camshafts having at least one cam that can be deactivated are disclosed, for example, in German Offenlegungsschrift No. 39 2 938. Such conventional camshafts have sleeves which are hydraulically driven along the shaft. These sleeves are components of dog clutches provided for each cam. The cams are normally deactivated and will rotate along with the shaft only when the sleeves are in a particular axial position and the clutches are engaged.

SUMMARY OF THE INVENTION

Accordingly, it is an object of the present invention to provide a camshaft having a deactivatable cam which overcomes the disadvantages of the prior art.

Another object of the invention is to provide such a camshaft which is more compact in the axial direction than those of the prior art.

These and other objects of the invention are attained by providing a camshaft with a deactivatable cam and a hydraulic clutch which is operable to secure the cam to the camshaft in which the clutch includes a bolt movable transversely to the axis of the camshaft between a locking position in which the cam will rotate with the camshaft and a cam release position in which the cam will not rotate with the camshaft.

Since the clutch provided in the camshaft arrangement according to the invention engages and disengages in a direction transverse to the camshaft axis instead of axially, the clutch requires no additional axial space. Another advantage of the invention is that the camshaft, which is subjected to torque and flexing forces, can be relatively thick because there are no sleeves on the shaft to take up circumferential space. Finally, centrifugal force can be utilized at higher speeds to make the cams rotate along with the shaft.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
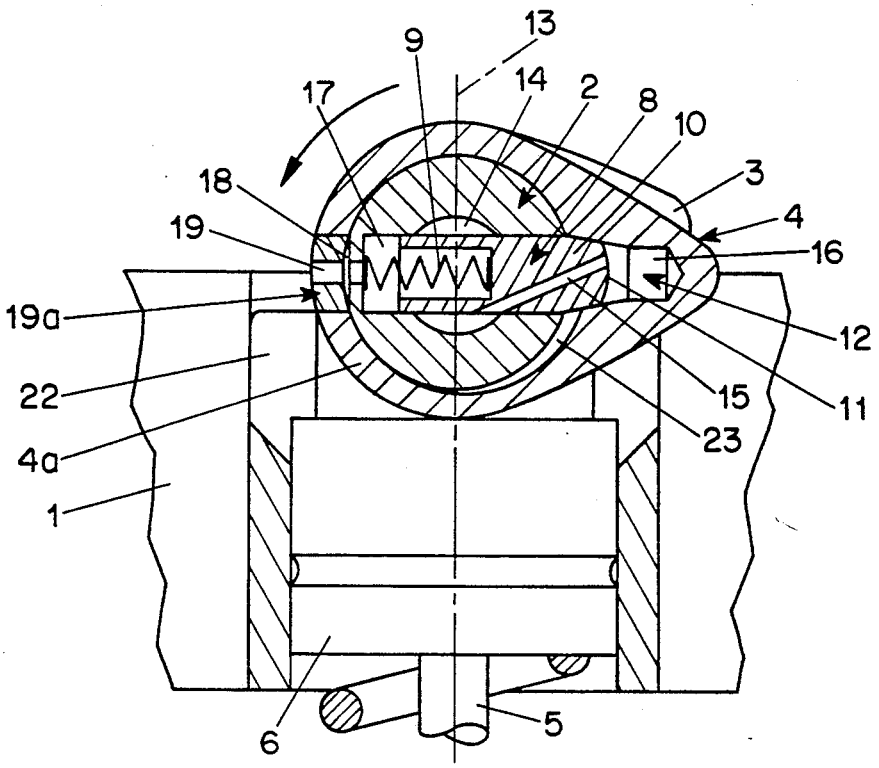
FIG. 1 is a cross-sectional view of the relevant portion of an engine, illustrating a representative camshaft arrangement according to the invention.
Figure 2:
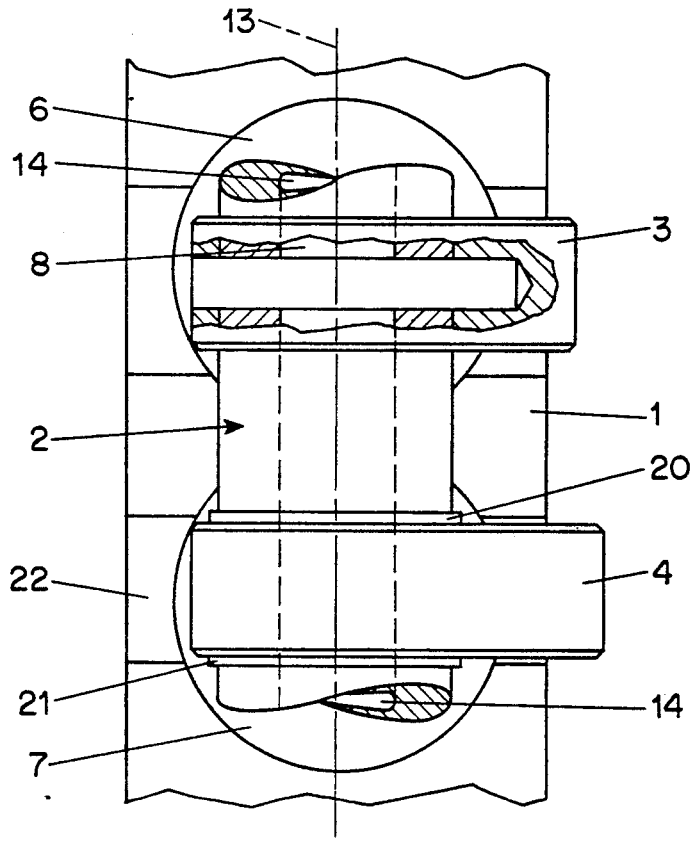
FIG. 2 is a plan view of the arrangement shown in FIG. 1.

In the typical embodiment of the invention shown in FIGS. 1 and 2, a camshaft 2, mounted on a cylinder head 1, is driven by an engine in the usual manner. The camshaft 2 has several cams, only two of which are illustrated. One cam 3 is affixed to the camshaft 2 so that it always rotates with the camshaft. Another cam 4, which has a base circle 4*a*, is arranged to be deactivated. The cams 3 and 4 actuate two separate lift valves for the same combustion chamber. The shaft 5 and associated closing spring for one such valve are shown in FIG. 1. Both of the valves are actuated through corresponding cup tappets 6 and 7 which are of conventional design and, accordingly, need not be described in detail herein. The tappets reciprocate in corresponding passages inside the cylinder head 1 which are coaxial with the valves.

Since the cam 3 is mechanically secured to the camshaft 2 so that it will always rotate with the camshaft as described above, it will actuate the corresponding valve, which is an intake valve in the present case, in every operating mode of the engine. The cam 4, on the other hand, is arranged to be deactivated so that it will rotate along with the shaft, and accordingly open its associated valve, only at high engine speeds. Consequently, the intake passage into the combustion chamber will pass through two open valves and have a correspondingly large cross-section only when the engine is operating at high speed.

The essential component of the clutch which connects and disconnects the cam 4 from the camshaft 2 as required is a bolt 8. A compression spring 9 accommodated inside the camshaft 2 forces the bolt 8 to the right, as viewed in FIG. 1, against a conical seat 11 in a bore 12 in the interior of the cam 4 in the absence of a countervailing force. The result is that the cam 4 is effectively locked on the camshaft 2 by a connection which is augmented by centrifugal force because the center of mass of the bolt 8 is spaced to the right, as viewed in FIG. 1, of the axis of the camshaft 2.

When the engine is operating at a low speed and only one intake valve, specifically, the valve associated with the cam 3, is required, hydraulic fluid passing through an axial supply channel 14 in the camshaft 2 and through a connecting channel 15 in the bolt 8 will increase the hydraulic pressure in a compartment 16 which communicates with the bore 12 in the projecting part of the cam 4. The bolt 8 will then be forced to the left, as seen in FIG. 1, against the force of the spring 9 and against centrifugal force until it clears the bore 12, which will allow the camshaft 2 to rotate within the cam 4. This rotation will commence when the leading side of the projection of the cam 4 engages the tappet 6 and cannot force the tappet down since the cam 4 is not coupled by the bolt 8 to the camshaft 2.

To the left of the bolt 8 as seen in FIG. 1 is a compartment 17 which accommodates part of the spring 9. This compartment is open through a bevel 18 and/or a bore 19 in the cam 4 to the atmosphere, thereby preventing air from being compressed in the compartment and interfering with the displacement of the bolt 8 to the left. The bore 19 passes through a plug 19*a* in the base circle 4*a* of the cam 4. The plug 19*a* closes an opening which is formed in the cam for manufacturing purposes.

Two annular guides 20 and 21, illustrated on each side of the cam 4 in FIG. 2, are provided to position the cam in the axial direction. On the other hand, it is also possible for the cam 4 to be axially secured by a corresponding groove 22 formed in the cylinder head.

Impact of the bolt 8 in the bore 12 upon actuation is alleviated by a groove 23 which is formed in the inner surface of the cam 4 upstream of the bolt. The depth of the groove 23 increases in the direction toward the bore 12 like that of a spiral groove.

Figure 3:
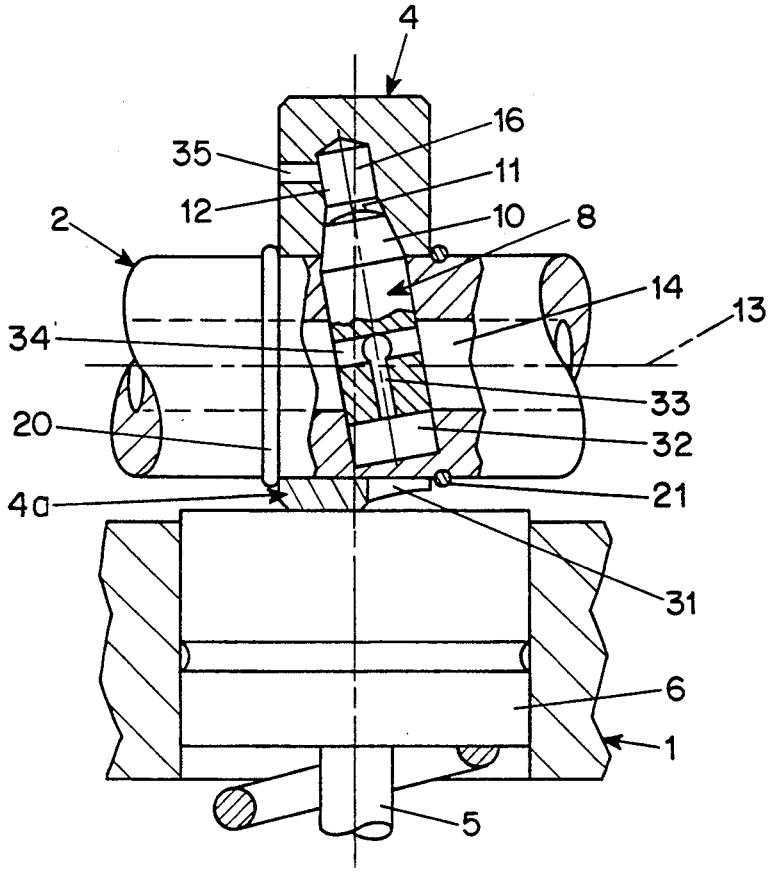
FIGS. 3 and 4 are longitudinal and transverse sectional views, respectively, of two further embodiments of the invention.
Figure 4:
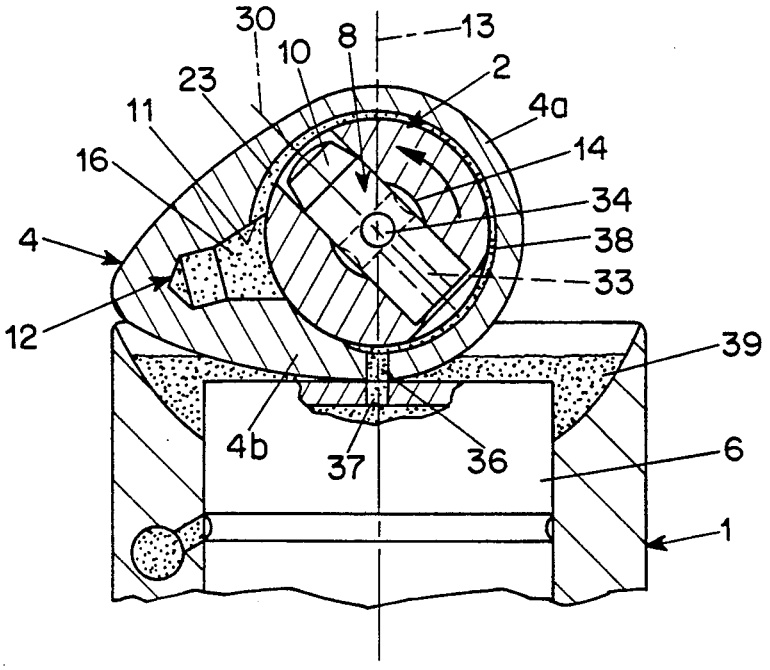

Components identical with those in FIGS. 1 and 2 are labelled with the same reference numbers in FIGS. 3 and 4.

As will be evident in particular from FIG. 3, the embodiment illustrated therein differs from that shown in FIGS. 1 and 2 in that the longitudinal axis 30 of the bolt 8, which is also the longitudinal axis of the transverse bore in the camshaft 2 which accommodates the bolt and of the bore 12 in the cam, is not perpendicular to the axis 13 of the camshaft but instead is slightly oblique. This slight angle makes it possible to eliminate the plug in the opening in the base circle 4a which is necessary to allow the seat 11 and the compartment 16 to be formed. Instead, the circle 4a is eccentrically narrowed in one region by a recess 31 at one side to provide an opening for manufacture and for introducing the bolt 8. As the cam surface rotates, it will actuate the tappet 6 as desired.

The bolt 8 illustrated in FIGS. 3 and 4 also has a slightly different design with respect to each of its positions and as to how it travels back and forth between them. A chamber 32, which is sealed from the atmosphere and pressurized, is located at the inner end of the bore 12 in the camshaft 2 which receives the bolt. The chamber 32 communicates through longitudinal and transverse channels 33 and 34 in the bolt 8 with the axial hydraulic supply channel 14 in the camshaft 2. Although the chamber 32 omits the spring which is included in the embodiment illustrated in FIG. 1, the compartment 16 has an air hole 35. Accumulation of hydraulic fluid in the chamber 32 displaces the bolt 8 into the locking position illustrated in FIG. 3 and maintains it there. Whereas in the embodiment illustrated in FIG. 1, the locking position is attained and ensured by the force of the spring 9, and hydraulic pressure must accumulate in the compartment 16 to force the bolt into its cam release position, in the embodiment illustrated in FIG. 3, the hydraulic system displaces and maintains the bolt 8 in its locking position.

The bolt 8 can be displaced out of the locking position illustrated in FIG. 3 into the release position illustrated in FIG. 4 after the pressure in the chamber 32 has been reduced by certain measures taken separately or in combination. The sloping conical surface of the seat 11, for example, generates bolt-entraining forces having force components which extend parallel to the axis 33 of the bolt 8 and tend to displace the bolt in the direction to shorten the chamber 32. The same effect can be attained by reducing the pressure in the chamber 32 below atmospheric pressure, in which event the atmospheric pressure in the bore 12 will tend to force the bolt 8 into its cam release position.

To secure the bolt 8 in its release position, the bolt can be designed such that its center of mass will, at least in the release position, be located in the lower half of the camshaft 2, as represented in FIG. 3. This approach produces a centrifugal force that stabilizes the bolt 8 in the release position. Magnetic stabilization is also possible, preferably at the end of the bolt 8 adjacent to the chamber 32 (FIG. 3) or 17 (FIG. 1). This may be accomplished, for example, by using a permanent magnet for the plug 19*a*.

FIG. 4 illustrates different ways of stabilizing the bolt 8 in the release position by supplying hydraulic fluid to the compartment 16. A prerequisite to this procedure is depressurization of the channel 14. One particular advantage of this embodiment is the simultaneous lubrication of the engaging surfaces of the cam 4 and the camshaft 2 when the cam is inactive.

The axial channel 14 in the camshaft is extremely effective for conducting hydraulic fluid from the compartment 16. For this purpose, an opening 36 is provided where the surface 4*b* of the inactive cam 4 rests against the tappet 6. The opening 36 communicates with a fluid outlet 37 in the tappet 6 either directly or indirectly by way of a bore when the cam is inactive. The fluid leaving the outlet 37 passes through the openings 37 and 36 into a space 38 between the facing circumferential surfaces of the cam 4 and the camshaft 2. As will be particularly evident from FIG. 4, the groove 23, which, as mentioned in conjunction with FIGS. 1 and 2, facilitates the engagement of the bolt 8 into the bore 12, continues into the vicinity of the opening 36. With the cam inactive and the bolt 8 in the release position illustrated in FIG. 4, the fluid passing through the opening 37 will apply pressure through that groove to the uppermost face of the bolt as viewed in FIG. 4.

FIG. 4 illustrates another solution to the problem which may be employed when the tappet is not hydraulically activated but is a strictly mechanical cup tappet, for example. In this case, the opening 37 in the bottom of the tappet is not necessary, but the opening 36 in the surface 4*b* of the cam 4 is retained. The tappet now functions as a tub 39 which acts like an oil tray, intercepting fluid passing through the opening 36. The rotation of the camshaft 2 within the inactive cam 4 exploits shear forces in order to force fluid through the opening 36 and establish pressure upstream of the end of the bolt 8 which is uppermost in FIG. 4.

It may be practical to conduct fluid from the tub 39 into the compartment 16 through a narrower parallel groove instead of through the groove 23, which is relatively wide and therefore allows for considerable splashing.

The present invention accordingly provides a simple arrangement for a space-saving camshaft having at least one cam which can be deactivated.

Although the invention has been described herein with reference to specific embodiments, many modifications and variations therein will readily occur to those skilled in the art. Accordingly, all such variations and modifications are included within the intended scope of the invention.

I claim:

1. A camshaft arrangement comprising a camshaft having at least one cam supported for rotation thereof, and a hydraulic clutch for locking the cam to the camshaft so that it will rotate with the camshaft and for releasing the cam from the camshaft so that it will not rotate with the camshaft, the hydraulic clutch comprising a bolt slidable in a transverse bore in the camshaft between a locking position wherein it extends into a bolt-receiving bore in the cam so that the cam will rotate with the camshaft and a release portion wherein it is withdrawn from the bore in the cam so that the cam will not rotate with the camshaft and wherein the cam has an internal groove extending circumferentially upstream of the bolt-receiving bore in the direction of motion between the bolt and the cam and which increases in depth as it approaches the bore to facilitate positioning of the bolt in the bolt-receiving.

2. A camshaft arrangement according to claim 1 wherein the bolt has a conical head and the bolt-receiving bore has a matching conical seat.

3. A camshaft arrangement according to claim 1 including a spring disposed within the camshaft engaging the end of the bolt opposite from the end received in the bolt-receiving bore, and a compartment in the transverse bore to receive hydraulic fluid.

4. A camshaft arrangement according to claim 3 wherein the camshaft has an axial hydraulic fluid supply channel and including a channel connecting the hydraulic fluid supply channel with the compartment.

5. A camshaft arrangement according to claim 1 wherein the transverse bore in the camshaft includes a pressure chamber that communicates with a hydraulic fluid supply channel in the end of the bolt opposite from the end received in the bolt-receiving bore and wherein a depressurization passage is associated with the bolt-receiving bore.

6. A camshaft arrangement according to claim 5 wherein in the pressure chamber communicates with an axial hydraulic fluid supply channel in the camshaft through at least one channel in the bolt.

7. A camshaft arrangement according to claim 5 wherein the pressure chamber is subjected to subatmospheric pressure and the coupling bore is pressurized to at least atmospheric pressure in order to displace the bolt into its bolt-receiving release position.

8. A camshaft arrangement according to claim 7, wherein the bolt-receiving bore can be pressurized with fluid at least to stabilize the bolt in its release position.

9. A camshaft arrangement comprising a camshaft having at least one cam supported for rotation thereon, and a hydraulic clutch for locking the cam to the camshaft so that it will rotate with the camshaft and for releasing the cam from the camshaft so that it will not rotate with the camshaft, the hydraulic clutch comprising a bolt slidable in a transverse bore in the camshaft between a locking position wherein it extends into a bolt-receiving bore in the cam so that the cam will rotate with the camshaft and a release position wherein it is withdrawn from the bore in the cam so that the cam will not rotate with the camshaft, wherein the transverse bore in the bolt-receiving that receives the bolt and the bolt-receiving bore inside the cam are oriented at an angle to the radius of the cam and the base circle of the cam is formed with opening to facilitate manufacture.

10. A camshaft arrangement according to claim 9 wherein the transverse bore in the camshaft includes a pressure chamber that communicates with a hydraulic fluid supply channel in the end of the bolt opposite from the end received in the bolt-receiving bore and wherein a depressurization pressure is associated with the bolt-receiving bore.

11. A camshaft arrangement according to claim 10, wherein the pressure chamber communicates with the axial hydraulic fluid supply channel in the camshaft through at least one channel in the bolt.

12. A camshaft arrangement according to claim 10 wherein the pressure chamber is subjected to subatmospheric pressure and the bolt-receiving bore is pressurized to at least atmospheric pressure in order to displace the bolt into its cam release position.

13. A camshaft arrangement according to claim 10 wherein the bolt-receiving bore can be pressurized with fluid at least to stabilize the bolt in its release position.

14. A camshaft arrangement comprising a camshaft having at lest one cam supported for rotation thereon, and a hydraulic clutch for locking the cam to the camshaft so that it will rotate with the camshaft and for releasing the cam from the camshaft so that it will not rotate with the camshaft, the hydraulic clutch comprising a bolt slidable in a transverse bore in the camshaft between a locking position wherein it extends into a bolt-receiving bore in the cam so that the cam will rotate with the camshaft and a release position wherein it is withdrawn from the bore in the cam so that the cam will not rotate with the camshaft wherein the transverse bore in the camshaft includes a pressure chamber that communicates with a hydraulic fluid supply channel in the end of the bolt opposite from the end received in the bolt-receiving bore and wherein a depressurization passage is associated with the bolt-receiving bore and wherein the center of mass of the bolt is located between the axis of the camshaft and the pressure chamber at least when the bolt is in the cam release position.

15. A camshaft arrangement according to claim 14 wherein the pressure chamber is subjected to subatmospheric pressure and the bolt-receiving bore is pressurized to at least atmospheric pressure in order to displace the bolt into its cam release position.

16. A camshaft arrangement according to claim 15 wherein the bolt-receiving bore can be pressurized with fluid at least to stabilize the bolt in its release position.

17. A camshaft arrangement comprising a camshaft having at lest one cam supported for rotation thereon, and a hydraulic clutch for locking the cam to the camshaft so that it will rotate with the camshaft and for releasing the cam from the camshaft so that it will not rotate with the camshaft, the hydraulic clutch comprising a bolt slidable in a transverse bore in the camshaft between a locking position wherein it extends into a bolt-receiving bore in the cam so that the cam will rotate with the camshaft and a release position wherein it is withdrawn from the bore in the cam so that the cam will not rotate with the camshaft wherein the transverse bore in the camshaft includes a pressure chamber that communicates with a hydraulic fluid supply channel in the end of the bolt opposite from the end received in the bolt-receiving bore and wherein a depressurization passage is associated with the bolt-receiving bore and wherein the bolt is maintained in the cam release position by magnetic attraction.

18. A camshaft arrangement comprising a camshaft having at least one cam supported for rotation thereon, and a hydraulic clutch for locking the cam to the camshaft so that it will rotate with the camshaft and for releasing the cam from the camshaft so that it will not rotate with the camshaft, the hydraulic clutch comprising a bolt slidable in a transverse bore in the camshaft between a locking position wherein it extends into a bolt-receiving bore in the cam so that the cam will rotate with the camshaft and a release position wherein it is withdrawn from the bore in the cam so that the cam will not rotate with the camshaft wherein the transverse bore in the camshaft includes a pressure chamber that communicates with a hydraulic fluid supply channel in the end of the bolt opposite from the end received in the bolt-receiving bore and wherein a depressurization passage is associated with the bolt-receiving bore and wherein the pressure chamber is subjected to subatmospheric pressure and the bolt-receiving bore is pressurized to at lest atmospheric pressure in order to displace the bolt into its cam release position wherein the bolt-receiving bore can be pressurized with fluid at least to stabilize the bolt in its release position and including a hydraulic tappet engaging the cam and wherein the cam and the tappet have openings for conducting fluid out of the tappet and into the coupling bore when the receiving-bolt inactive.

19. A camshaft arrangement comprising a camshaft having at least one cam supported for rotation thereon, and a hydraulic clutch for locking the cam to the camshaft so that it will rotate with the camshaft and for releasing the cam from the camshaft so that it will not rotate with the camshaft, the hydraulic clutch comprising a bolt slidable in a transverse bore in the camshaft between a locking position wherein it extends into a bolt-receiving bore in the cam sot that the cam will rotate with the camshaft and a release position wherein it is withdrawn from the bore in the cam so that the cam will not rotate with the camshaft wherein the transverse bore in the camshaft includes a pressure chamber that communicates with a hydraulic fluid supply channel in the end of the bolt opposite from the end received in the bolt-receiving bore and wherein a depressurization passage is associated with the bolt-receiving bore and wherein the pressure-chamber is subjected to subatmospheric pressure and the bolt-receiving bore is pressurized to at least atmospheric pressure in order to displace the bolt into its cam release position wherein the coupling bore can be pressurized with fluid at least to stabilize the bolt in its release position and wherein the adjacent surfaces of the camshaft and of the cam are designed to conduct the fluid from an external reservoir through an opening in the side of the cam into the coupling bore by their relative motion when the cam is inactive.

20. A camshaft arrangement according to claim 19 including a fluid-retaining component adjacent to the cam to receive hydraulic fluid from the cam and an adjacent tappet.

21. A camshaft arrangement according to claim 19 wherein at least one of the adjacent surfaces of the cam and the camshaft has at lest one groove with a cross-section arranged so that the hydraulic fluid conducted thereby will exert a desired pressure on the bolt.

* * * * *

UNITED STATES PATENT AND TRADEMARK OFFICE

CERTIFICATE OF CORRECTION

PATENT NO. : 5,239,885

DATED : August 31, 1993

INVENTOR(S) : Dieter Voigt

It is certified that error appears in the above-identified patent and that said Letters Patent is hereby corrected as shown below:

Column 1, line 31, "39 2 938" should read --39 20 938--;

Column 4, line 67, "thereof" should read --thereon--;

Column 5, line 7, "portion" should read --position--;

Column 5, line 14, "bolt-receiving" should read --bolt-receiving bore--;

Column 5, line 35, "wherein in" should read --wherein--;

Column 5, line 40 "coupling bore" should read --bolt-receiving bore--;

Column 5, line 42, "bolt-receiving" should read --cam--;

Column 5, line 59, "bolt-receiving" should read --camshaft--;

Column 5, line 62, "opening" should read --an opening--;

Column 6, line 1, "pressure" should read --passage--;

Column 6, line 44, "at lest" should read --at least--;

Column 7, line 13, "at lest" should read --at least--;

Column 7, lines 19-20, "coupling bore when the receiving-bolt inactive" should read --bolt-receiving bore when the cam is inactive--;

Column 8, bridging lines 12-13, "coupling" should read --bolt-receiving--;

UNITED STATES PATENT AND TRADEMARK OFFICE

CERTIFICATE OF CORRECTION

PATENT NO. : 5,239,885

DATED : August 31, 1993

INVENTOR(S) : Dieter Voigt

It is certified that error appears in the above-identified patent and that said Letters Patent is hereby corrected as shown below:

Column 8, bridging lines 17-18, "coupling" should read --bolt-receiving--;

Column 8, line 26, "at lest" should read --at least--.

Signed and Sealed this

Third Day of May, 1994

Bruce Lehman

*Attest:*

BRUCE LEHMAN

*Attesting Officer*

*Commissioner of Patents and Trademarks*